US006755005B2

(12) United States Patent
Czachor et al.

(10) Patent No.: US 6,755,005 B2
(45) Date of Patent: Jun. 29, 2004

(54) METHOD AND APPARATUS FOR STIFFENING AND APPARATUS

(75) Inventors: Robert Paul Czachor, Cincinnati, OH (US); Michael Leon Barron, Ten Mile, TN (US)

(73) Assignee: General Electric Company, Schenectady, NY (US)

( * ) Notice: Subject to any disclaimer, the term of this patent is extended or adjusted under 35 U.S.C. 154(b) by 38 days.

(21) Appl. No.: 09/928,293

(22) Filed: Aug. 10, 2001

(65) Prior Publication Data

US 2003/0029133 A1 Feb. 13, 2003

(51) Int. Cl.[7] ..... E04C 2/32; E04C 2/38; E04C 3/30

(52) U.S. Cl. ..... 52/736.4; 52/783.11; 52/630

(58) Field of Search ..... 52/783.19, 783.11, 52/630, 723.1, 723.2, 736.3, 736.4, 170, 737.4, 737.5; 165/177; 405/49; 248/903, 49

(56) References Cited

U.S. PATENT DOCUMENTS

| | | | | | |
|---|---|---|---|---|---|
| 359,622 | A | * | 3/1887 | Murray | 405/272 |
| 937,448 | A | * | 10/1909 | Lamb | 52/723.2 |
| 966,337 | A | * | 8/1910 | Lamb | 52/723.2 |
| 1,517,846 | A | * | 12/1924 | Lewis | 52/302.5 |
| 1,625,061 | A | * | 4/1927 | Trout | |
| 1,784,770 | A | * | 12/1930 | Wiley | 52/170 |
| 2,641,830 | A | * | 6/1953 | Lamb | 228/150 |
| 2,897,553 | A | * | 8/1959 | Gorrow | 52/723.2 |
| 3,542,152 | A | * | 11/1970 | Adamson | 181/214 |
| 3,685,229 | A | * | 8/1972 | Sale | |
| 3,831,675 | A | * | 8/1974 | McLain | 165/177 |
| 3,844,347 | A | * | 10/1974 | Stotzel | |
| 3,848,697 | A | * | 11/1974 | Jannot et al. | 181/220 |
| 3,918,626 | A | * | 11/1975 | McLain | 228/147 |
| 3,921,883 | A | * | 11/1975 | McLain | 228/17.5 |
| 4,037,626 | A | * | 7/1977 | Roberts, Jr. | 138/109 |
| 4,077,206 | A | * | 3/1978 | Ayyagari | 60/262 |
| 4,147,029 | A | | 4/1979 | Sargisson | |
| 4,244,156 | A | * | 1/1981 | Watts, Jr. | 52/746.1 |
| 4,414,257 | A | * | 11/1983 | Haraga | |
| 4,481,698 | A | * | 11/1984 | Salerno | 29/889.22 |
| 4,848,514 | A | * | 7/1989 | Snyder | 181/290 |
| 5,201,136 | A | * | 4/1993 | LaMorte | |
| 5,222,360 | A | | 6/1993 | Antuna et al. | |
| 5,307,623 | A | | 5/1994 | Antuna et al. | |
| 5,316,997 | A | * | 5/1994 | Toyoda et al. | 502/314 |
| 5,320,307 | A | | 6/1994 | Spofford et al. | |
| 5,327,962 | A | * | 7/1994 | Head | |
| 5,443,229 | A | | 8/1995 | O'Brien et al. | |
| 5,452,575 | A | | 9/1995 | Freid | |
| 5,632,674 | A | * | 5/1997 | Miller | |
| 5,765,880 | A | * | 6/1998 | Goddard | 285/231 |
| 5,782,041 | A | * | 7/1998 | Filipescu | 52/101 |
| 5,839,477 | A | * | 11/1998 | Murayama | 138/121 |
| 5,888,600 | A | | 3/1999 | Wycech | |
| 5,921,500 | A | | 7/1999 | Ellis et al. | |
| 5,927,644 | A | | 7/1999 | Ellis et al. | |
| 6,003,274 | A | | 12/1999 | Wycech | |
| 6,019,549 | A | * | 2/2000 | Blair et al. | 405/216 |
| 6,041,590 | A | * | 3/2000 | Hayton et al. | 60/766 |
| 6,058,673 | A | | 5/2000 | Wycech | |
| 6,207,293 | B1 | * | 3/2001 | Ragland et al. | 428/594 |
| 6,296,203 | B1 | | 10/2001 | Manteiga et al. | |
| 6,309,131 | B1 | | 10/2001 | Dawson | |
| 6,330,985 | B1 | | 12/2001 | Manteiga et al. | |
| 6,401,448 | B1 | | 6/2002 | Manteiga et al. | |

* cited by examiner

*Primary Examiner*—Carl D. Friedman
*Assistant Examiner*—Kevin McDermott
(74) *Attorney, Agent, or Firm*—Nathan D. Herkamp; Armstrong Teasdale LLP; Robert B. Reeser, III

(57) ABSTRACT

A stiffener system includes a stiffener and a fastener means. The stiffener includes an extruded body that includes a plurality of projections. The stiffener couples to the apparatus to facilitate increasing a structural integrity of the apparatus. The fastener means secures the stiffener to the apparatus.

18 Claims, 3 Drawing Sheets

METHOD AND APPARATUS FOR STIFFENING AND APPARATUS

BACKGROUND OF THE INVENTION

This invention relates generally to structural support devices and more particularly, methods and apparatus for providing structural support to an apparatus.

As machinery operates, components coupled to the machinery may be subjected to vibrational stresses. Over time, continued exposure to vibrational stresses may cause damage to such components.

To facilitate reducing the effects of vibrational stresses, at least some known machinery components include structural supports. For example, within some known gas turbine engines, tubular components are reinforced with external brackets. Other known tubular components are reinforced with complex damping systems. However, such external supports are expensive and may be difficult to couple to attached components. Furthermore, depending on a length of the component, as the component is distressed, bending moments may be generated between the external support structures over time, such bending moments may weaken the components and eventually reduce a useful life of the component.

BRIEF SUMMARY OF THE INVENTION

In one aspect of the invention a stiffener for an apparatus is provided. The stiffener includes a body including a plurality of projections. The stiffener couples to the apparatus such that the projections circumscribe the apparatus and such that the stiffener facilitates increasing a stiffness-to-mass ratio of the apparatus.

In another aspect of the invention, a stiffener system including a stiffener and a fastening means is provided. The stiffener includes an extruded body that includes a plurality of projections. The stiffener couples to the apparatus to facilitate increasing a stiffness-to-mass ratio of the apparatus. The fastener means secures the stiffener to the apparatus.

In a further aspect, a method for increasing a stiffness-to-mass ratio of the apparatus is provided. The method includes the steps of providing a stiffener including an extruded body including a plurality of projections and coupling the stiffener to the apparatus such that the projections circumscribe the apparatus to facilitate increasing a stiffness-to-mass ratio of the apparatus.

DETAILED DESCRIPTION OF THE INVENTION

Figure 1:
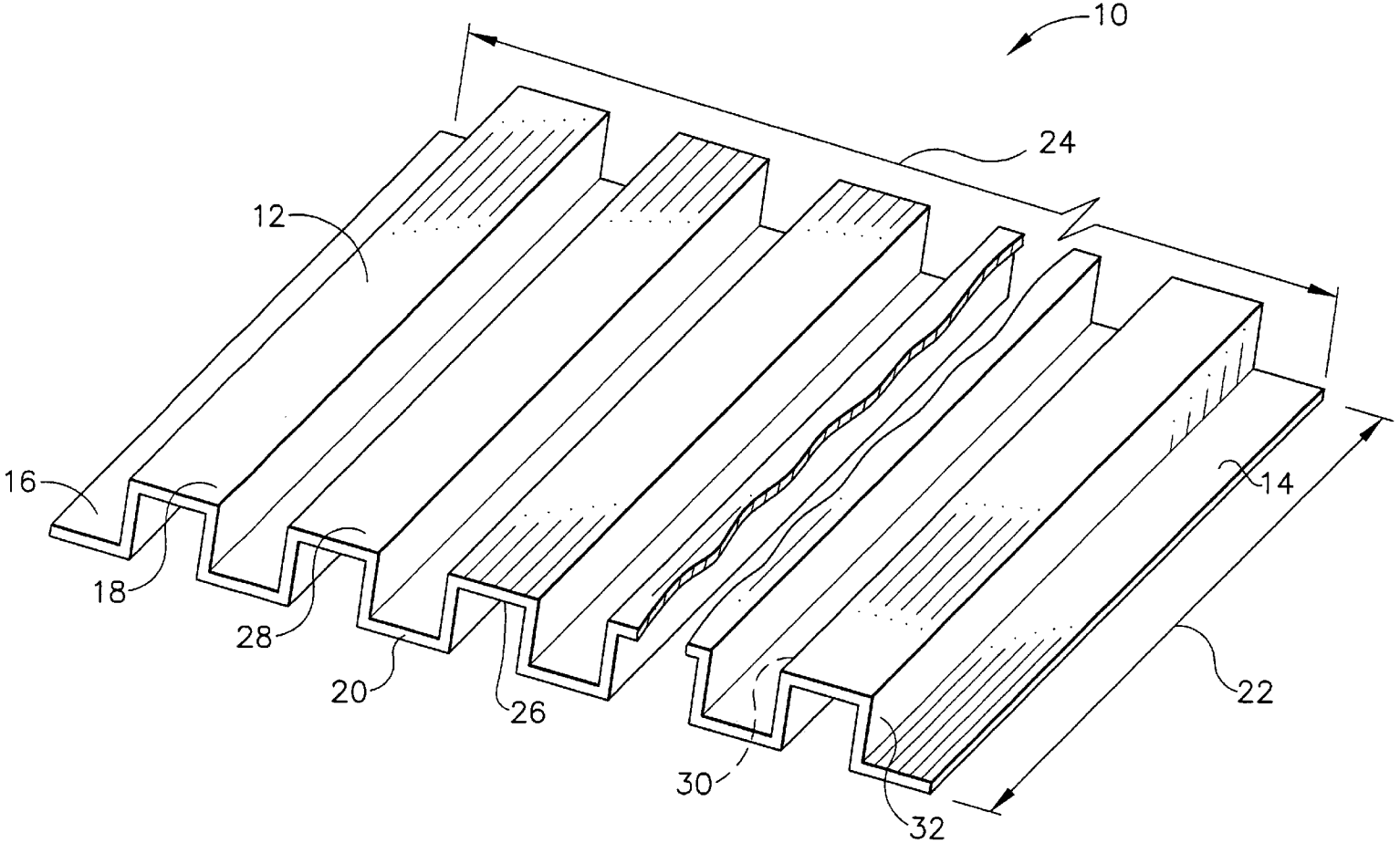
FIG. 1 is a perspective view of an exemplary embodiment of a stiffener.

FIG. 1 is a perspective view of an exemplary embodiment of a stiffener 10. In the exemplary embodiment, stiffener 10 is extruded and is corrugated, such that stiffener 10 includes a plurality of projections 12 extending from a body 14. In one embodiment, projections 12 are formed integrally with stiffener body 14. Stiffener 10 includes a bottom surface 16 and an oppositely disposed top surface 18 that extends substantially parallel to bottom surface 16. Stiffener 10 has a thickness 20 that is measured between bottom surface 16 and top surface 18. Thickness 20 is variably selected depending on an intended use of stiffener 10 and is selected to ensure stiffener 10 has a pre-determined flexibility for the intended use. Stiffener 10 also has a length 22 and a width 24. Stiffener length 22 and width 24 are both variably selected depending on the intended use of stiffener 10. In one embodiment, stiffener 10 is formed from a single sheet of metallic material. In another embodiment, stiffener 10 is formed from a non-metallic material. Alternatively, stiffener 10 is formed from a plurality of sheets connected together.

In the exemplary embodiment, projections 12 are substantially identical and extend substantially perpendicularly from stiffener bottom surface 16. More specifically, projections 12 are arranged in a cyclic pattern and extend lengthwise and widthwise across stiffener 10 in a longitudinal-axial configuration. Adjacent projections 12 are substantially parallel to each other, and each projection 12 includes a bottom surface 26, a top surface 28, and a pair of sidewalls 30 and 32. In the exemplary embodiment, projection 12 top surface 28 and sidewalls 30 and 32 define a substantially rectangular cross-sectional profile. Alternatively, projection 12 defines a non-rectangular cross-sectional profile. For example, projection 12 defines, but is not limited to defining, at least one of a circular, a triangular, and a T-shaped cross-sectional profile. In an alternative embodiment, projections 12 are aligned at an angle with respect to a centerline (not shown) of stiffener 10. In a further alternative embodiment, projections 12 are arranged in a helical configuration.

In use, stiffener 10 is coupled to an apparatus (not shown in FIG. 1) to facilitate increasing a stiffness-to-mass ratio of the apparatus. Furthermore, stiffener 10 facilitates increasing a natural frequency of the apparatus. In one embodiment, stiffener 10 is attached to the apparatus and circumscribes an exterior of the apparatus. In a further embodiment, stiffener 10 is attached to the apparatus and circumscribes an interior cavity defined within the apparatus.

Figure 2:
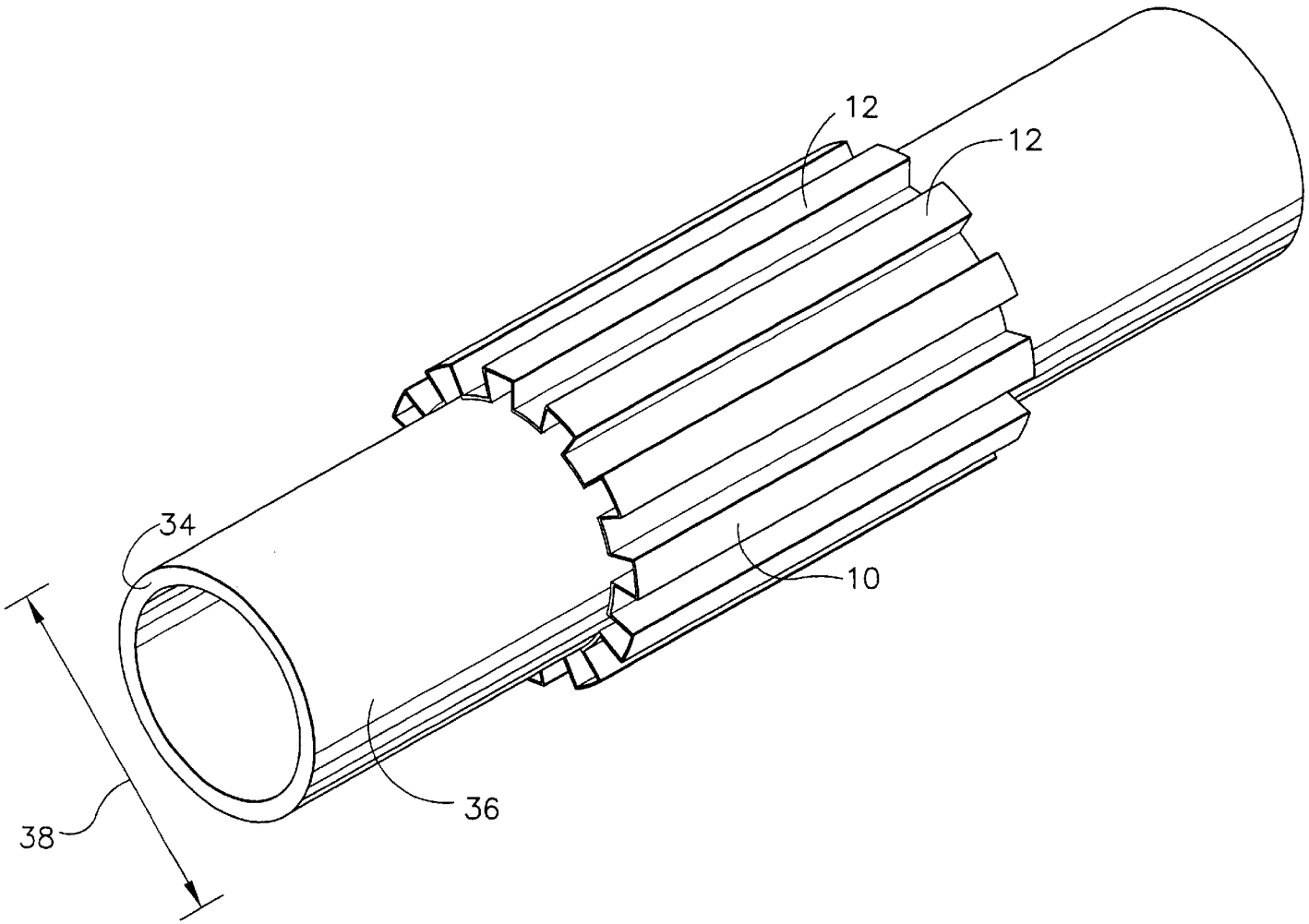
FIG. 2 is an alternative view of the stiffener shown in FIG. 1 coupled to an apparatus.

FIG. 2 is an alternative perspective view of stiffener 10 coupled to an apparatus 34. In the exemplary embodiment, apparatus 34 is substantially tubular and defines a continuous exterior surface 36 to which stiffener 10 is attached. Exterior surface 36 defines a substantially circular cross-sectional profile for apparatus 34. Alternatively, exterior surface 36 defines a non-circular cross-sectional profile. For example exterior surface 36 defines, but is not limited to defining, at least one of a triangular, an I-shaped, and a T-shaped cross-sectional profile.

In the exemplary embodiment, stiffener 10 is coupled to apparatus 34 such that projections 12 circumscribe apparatus 34, and projections 12 extend radially outward from apparatus 34. Stiffener 10 is secured to apparatus 34 using a fastener means (Not shown in FIG. 2). In one embodiment, the fastener means is an adhesive fastener such as, but is not limited to, a metal glue or a plastic glue. In another embodiment, the fastener means is an adhesive, such as, but not limited to, a double-sided tape, a masking tape, a electrical tape, or a duct tape. In a further embodiment, the fastener means is a mechanical fastener, such as, but not limited to, a nut and bolt, screws, rivets, staples, or clamps.

In use, stiffener 10 is coupled to apparatus 34, and facilitates increasing a stiffness-to-mass ratio of apparatus 34. During operation, stiffener 10 increases a diameter 38 of apparatus 34, and provides a local increase in stiffness and a corresponding increase in the natural frequency as apparatus 34 deflects.

Figure 3:
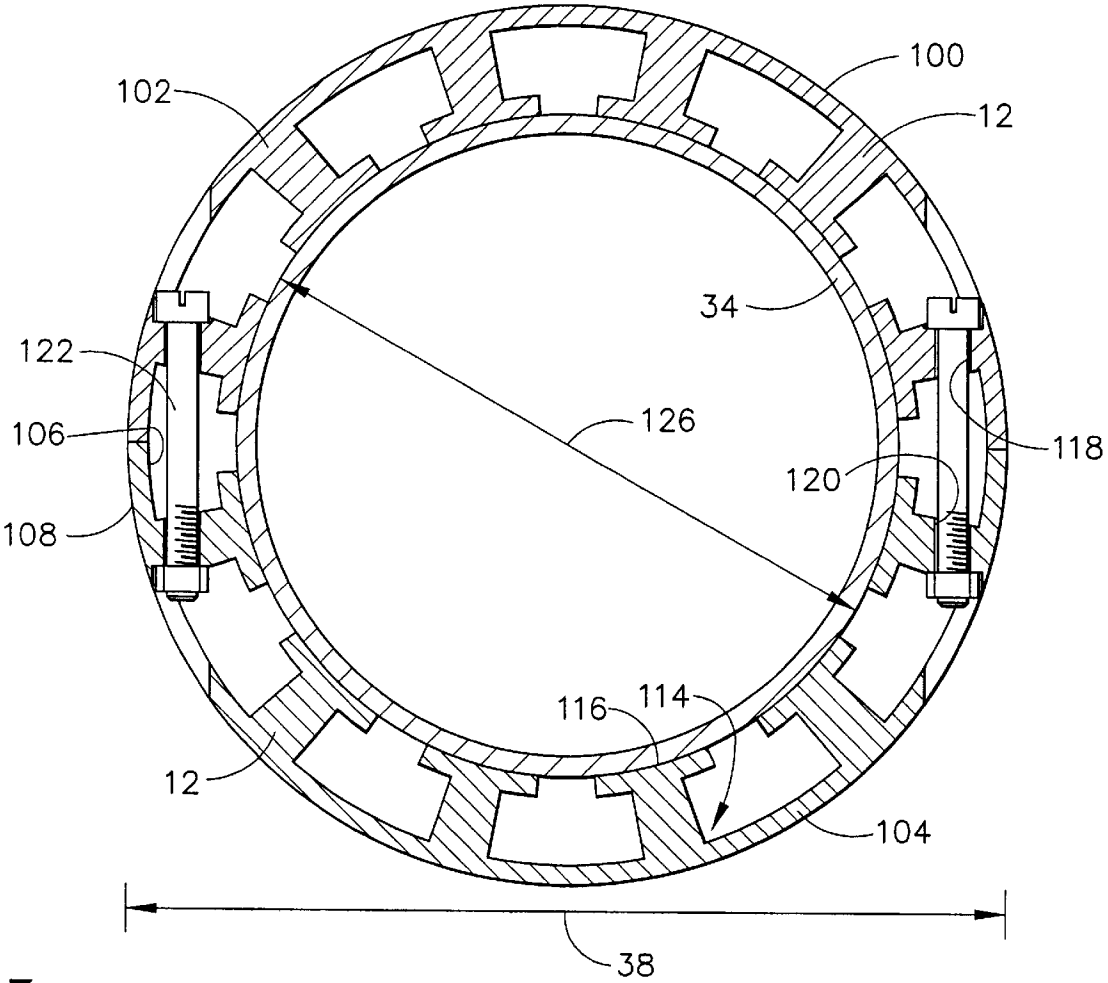
FIG. 3 is a cross-sectional view of an alternative embodiment of a stiffener coupled to an apparatus.

FIG. 3 is a perspective view of an alternative embodiment of a stiffener 100 coupled to apparatus 34. Stiffener 100 is substantially similar to stiffener 10, shown in FIGS. 1 and 2, and components in stiffener 100 that are identical to components of stiffener 10 are identified in FIG. 3 using the same reference numerals used in FIGS. 1 and 2. Accordingly, stiffener 100 includes projections 12 and an outer cover 102.

Outer cover 102 extends across stiffener 100 and has a thickness 104 that is measured between a bottom surface 106 and a top surface 108. Thickness 104 is variably selected depending on an intended use of stiffener 100 and to ensure stiffener 100 has a pre-determined flexibility for the intended use. Outer cover 102 has a length 22 and a width 24 (Shown in FIG. 1), both of which are variably selected depending on an intended use of outer cover 102. In one embodiment, outer cover 102 is formed from a single sheet of metallic material. In a further embodiment, outer cover 102 is formed from a non-metallic material. Alternatively, outer cover 102 is formed from a plurality of sheets connected together.

Projections 12 extend substantially perpendicularly from stiffener bottom surface 16. More specifically, projections 12 are arranged in a cyclic pattern and extend lengthwise and widthwise across stiffener 100. Adjacent projections 12 are substantially parallel to each other, and each projection 12 includes a bottom surface 114, a top surface 116, and a pair of sidewalls 118 and 120. In the exemplary embodiment, projection 12 top surface 116 and sidewalls 118 and 120 define a substantially T-shaped cross-sectional profile. Alternatively, each projection 12 defines a non-T-shaped cross-sectional profile. For example, such cross-sectional profiles include, but are not limited to, I-shaped, L-shaped, and V-shaped cross-sectional profiles.

In the exemplary embodiment, outer cover 102 is attached to stiffener 100 by a fastener means 122. Fastener means 122 extends through a portion 124 of outer cover 102. In one embodiment, fastener means 122 is an adhesive fastener, such as, but not limited to, a metal glue or a plastic glue. In another embodiment, fastener means 122 is an adhesive fastener, such as, but not limited to, double-sided tape, masking tape, electrical tape, or duct tape. In a further embodiment, fastener means 122 is a mechanical fastener, such as, but not limited to, nut and bolt, screws, rivets, staples, and clamps.

In use, outer cover 102 is attached to stiffener 100 and stiffener 100 is attached to apparatus 34, to facilitate increasing a stiffness-to-mass ratio of apparatus 34. During operation, stiffener 100 increases a diameter 126 of apparatus 34, and provides a local increase in stiffness and a corresponding increase in the natural frequency as apparatus 34 deflects. In one embodiment, stiffener 100 is attached to apparatus 34 to circumscribe an exterior of apparatus 34. In a further embodiment, stiffener 100 is attached to apparatus 34 to circumscribe an interior cavity defined within apparatus 34. Outer cover 102 facilitates an increase in strength, and a reduction in installation time of stiffener 100.

While the invention has been described in terms of various specific embodiments, those skilled in the art will recognize that the invention can be practiced with modification within the spirit and scope of the claims.

What is claimed is:

1. A method for increasing a stiffness-to-mass ratio of an apparatus, said method comprising:

providing a single stiffener including an extruded, corrugated body including a plurality of projections; and coupling the single stiffener to the apparatus with a mechanical fastener such that the projections circumscribe the apparatus to facilitate increasing a stiffness-to-mass ratio of the apparatus, and such that a first end of the stiffener is coupled against a second end of the same stiffener.

2. A method in accordance with claim 1 wherein said step of providing a stiffener further comprises providing a stiffener including a body fabricated from a metallic material.

3. A method in accordance with claim 2 wherein said step of providing a stiffener further comprises providing a stiffener including projections formed integrally with the body.

4. A method in accordance with claim 3 wherein said step of coupling the stiffener to the apparatus further comprises coupling the stiffener to the apparatus such that the projections extend radially outward from the apparatus.

5. A method in accordance with claim 4 wherein said step of coupling the stiffener to the apparatus further comprises coupling the stiffener to the apparatus to facilitate increasing a stiffness-to-mass ratio of the apparatus.

6. A method in accordance with claim 5 wherein said step of providing a stiffener further comprises providing a stiffener including a plurality of identical projections and a body that is flexible.

7. A single stiffener for an apparatus, said single stiffener comprising a corrugated body comprising a first end, a second end, and a plurality of projections extending therebetween, said stiffener coupled to the apparatus by a mechanical fastener such that said projections circumscribe the apparatus, and such that said body first end is coupled against said body second end such that said stiffener facilitates increasing a stiffness-to-mass ratio of the apparatus, said stiffener uncoupleable from the apparatus when said mechanical fastener is released.

8. A stiffener in accordance with claim 7 wherein said stiffener body is flexible.

9. A stiffener in accordance with claim 7 wherein adjacent said projections are substantially identical.

10. A stiffener in accordance with claim 7 wherein said projections are formed integrally with said body.

11. A stiffener in accordance with claim 7 wherein said stiffener is fabricated from a metallic material.

12. A stiffener in accordance with claim 7 wherein said stiffener is further configured to couple to the apparatus such that said projections extend radially outward from the apparatus.

13. A stiffener in accordance with claim 7 wherein said stiffener is configured to couple to the apparatus to facilitate increasing a natural frequency of the apparatus.

14. A stiffener system comprising:

a single stiffener comprising an extruded, corrugated body extending between a first end and a second end, said body comprising a plurality of projections, said single stiffener configured to couple to an apparatus such that said body first end is coupled against said body second end such that said projections circumscribe the apparatus to facilitate increasing a stiffness-to-mass ratio of the apparatus; and a fastener means for securing said stiffener to the apparatus.

15. A stiffener system in accordance with claim 14 wherein said fastener means comprises at least one of an adhesive means and a mechanical fastener means for coupling said stiffener to the apparatus.

16. A stiffener system in accordance with claim 14 wherein said stiffener body is flexible such that said stiffener is configured to circumscribe the apparatus.

17. A stiffener system in accordance with claim 14 wherein adjacent said projections are substantially identical.

18. A stiffener system in accordance with claim 14 wherein adjacent said body stiffeners are formed integrally with said projections.

* * * * *

UNITED STATES PATENT AND TRADEMARK OFFICE

CERTIFICATE OF CORRECTION

PATENT NO. : 6,755,005 B2
DATED : June 29, 2004
INVENTOR(S) : Czachor et al.

It is certified that error appears in the above-identified patent and that said Letters Patent is hereby corrected as shown below:

Title page,
Item [54], Title, delete "AND APPARATUS" and insert therefor
-- AN APPARATUS --.

Signed and Sealed this

Sixth Day of December, 2005

JON W. DUDAS
*Director of the United States Patent and Trademark Office*